United States Patent [19]

Shemtov

[11] 4,300,691

[45] Nov. 17, 1981

[54] DISPLAY STAND AND METHOD OF FORMING SAME

[76] Inventor: Israel Shemtov, 1594 Carroll St., Brooklyn, N.Y. 11213

[21] Appl. No.: 44,561

[22] Filed: Jun. 1, 1979

[51] Int. Cl.[3] ..... A47F 5/02

[52] U.S. Cl. ..... 211/131; 206/45.31; 248/174

[58] Field of Search ..... 211/131, 133, 132, 163, 211/24; 248/174; 206/45.31; 229/42

[56] References Cited

U.S. PATENT DOCUMENTS

| | | | |
|---|---|---|---|
| 1,124,175 | 1/1915 | Sackett | 248/174 X |
| 3,014,632 | 12/1961 | Kuchenbecker | 229/42 UX |
| 3,314,532 | 4/1967 | Henry | 206/45.31 |
| 3,877,396 | 4/1975 | Patterson | 248/174 X |
| 4,030,608 | 6/1977 | Howard | 211/131 |
| 4,030,660 | 6/1977 | Rada et al. | 229/42 |
| 4,182,244 | 1/1980 | Hutchins et al. | 211/194 X |

*Primary Examiner*—Roy D. Frazier
*Assistant Examiner*—Robert W. Gibson, Jr.

[57] ABSTRACT

This disclosure is directed to a display stand and method of forming the same which comprises die cutting a sheet of cardboard to define the side walls of the stand and laminating the die cut cardboard between two sheets of a flexible plastic material whereby the flexible plastic sheets are heat sealed together in accordance with the contour of the die cut cardboard to define side walls which are heat sealed together at opposed corners to define a completed tubular stand body and which body may be provided with partitions and separations to provide for a plurality of compartments which are rendered readily accessible for displaying and selecting merchandise to be displayed thereby.

6 Claims, 9 Drawing Figures

DISPLAY STAND AND METHOD OF FORMING SAME

PRIOR ART

Display stands are known to take many forms and they are made of many types of different materials depending upon the nature and use of the display stand. The present invention is directed to a relatively simple and inexpensive type of display stand which heretofore are generally made of cardboard type materials. However the known cardboard type of display stands have the disadvantage in that they are quickly subjected to abuse and deterioration and as a consequence have a relatively short life span. Also the known cardboard type display stands do not provide an image of quality to the merchandise being displayed thereby, and may detract the buyer's appeal from purchasing the goods displayed thereby. Also such cardboard type displays cannot be generally exposed to water or weather, and therefore their uses are severely limited.

OBJECTS

An object of this invention is to provide an improved display stand and method of making the same which is relatively simple, inexpensive and positive in operation.

Another object is to provide a display stand having a plurality of "pigeon hole" type compartments for displaying various kinds of merchandise and whereby the merchandise is rendered readily accessible to the consumer.

Another object is to provide a display stand formed of relative inexpensive material which is capable of enhancing the quality of the merchandise displayed therein.

Another object is to provide a display stand which is formed of relatively inexpensive material and which is capable of presenting an image of quality to products displayed thereby.

Another object is to provide a display stand constructed to attract buyer appeal to the products displayed thereby.

BRIEF SUMMARY OF THE INVENTION

The foregoing objects and other features and advantages of this invention are attained by a display stand which comprises a tubular body portion which is defined by a cardboard side section die cut so as to define a plurality of access openings to provide access to the merchandise displayed therein; and which side sections are laminated between sheets of plastic material whereby the plastic material is shaped to the contour of the cardboard side sections by heat sealing the respective sheets of plastic together in accordance with the contour of the side sections.

The respective side walls are die-cut to provide a series of openings and associated flaps which flaps are arranged to be inwardly folded and define supports to which partition members are secured, and to which partitions separators as attached to define a series of compartments for receiving the merchandise. The compartments so formed are disposed opposite the respective openings. In the completed form, the stand defines a "pigeon hole" type display stand wherein each side wall has a plurality of openings to provide access to the merchandise stored in the respective compartments. The stand body is mounted on a rotatable base or support so that a customer or sales person can by simply rotating the stand body attain access to any opening formed in any one of the side walls.

FEATURES

A feature of this invention resides in the provision wherein the laminating of the cardboard side walls between sheets of plastic substantially enhances the appearance and life of the display stand.

Another feature resides in a display stand construction in which a plurality of articles can be effectively displayed and which stand is constructed of a minimum of like component sections.

Another feature resides in the provision of a method of fabricating a display stand of cardboard and plastic whereby the cardboard lends rigidity and strength to the stand and the plastic gives to the stand the appearance of quality and durability.

Another feature resides in the provision wherein the display stand is fabricated of a minimum of similar component parts which can be readily assembled.

Other features and advantages will become more readily apparent when considered in view of the drawings and specifications in which.

DETAIL SPECIFICATION

Figure 1:
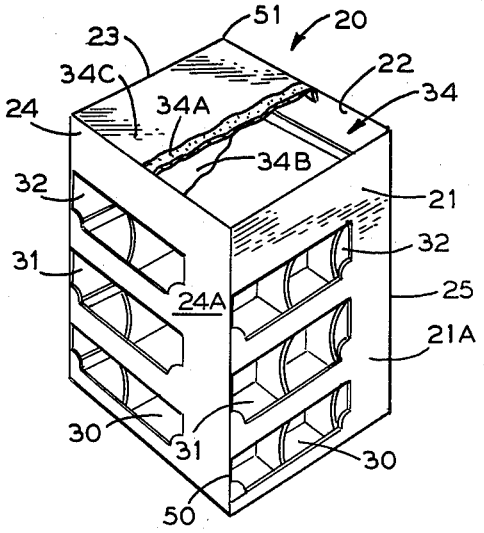
FIG. 1 is a perspective view of the display stand embodying the invention.

Referring to the drawings therein shown in FIG. 1 a perspective view of a display stand 20 embodying the invention. The display stand comprises a plurality of side walls 21, 22, 23 and 24 which are rectangularly disposed to define a tubular body portion 25. Disposed in spaced relationship within the tubular body portion 25 are a plurality of horizontal partitions 26, 26A, 26B and 26C. As shown, each partition defines a tier on which an article of merchandise is stored and/or displayed.

Figure 8:
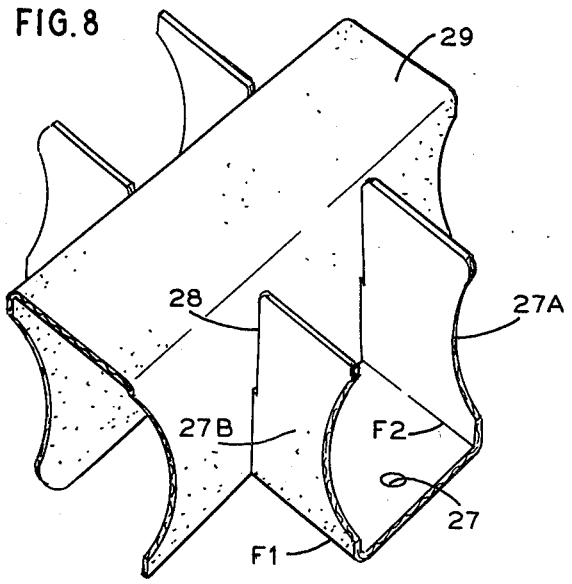
FIG. 8 is a detail perspective view of the separator member associated with a partition member.

Connected to each partition by a suitable fastener or rivet 27R is a sheet of blank material, e.g. cardboard 27 which is provided with a pair of foldlines $F_1$ and $F_2$ about which blank 27 is folded so that end flaps 27A and 27B are disposed normal to its associated partition member. The folded ends 27A and 27B of blank 27 are provided with slots 28 for receiving a complementary blank 29 similarly folded and disposed at right angle thereto as seen in FIG. 8. The arrangement is such that the criss-cross folded blanks 27 and 29 as shown in FIG. 8 and associated partition define a tier having a plurality of "pigeon hole" type compartments. In the illustrated embodiment each tier has nine such compartments for receiving an article of merchandise.

Figure 4:
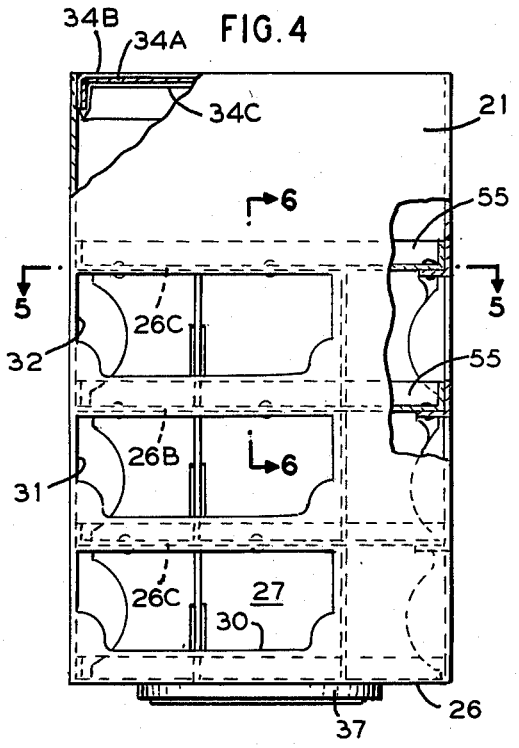
FIG. 4 is a side elevation view of the display stand.

As best seen in FIGS. 1 and 4 each side wall 21, 22, 23 and 24 is defined with a plurality of vertically spaced access openings 30, 31 and 32. In the illustrated embodiment the access openings 30, 31, and 32 are disposed to one side of the side wall so that two "pigeon" compartments on any one tier is common to one opening on a side. The other "pigeon" compartment is rendered accessible by the opening on the next adjacent side. Each compartment is thus rendered readily accessible and the side wall portions 21A, 22A, 23A and 24A of the respective side walls 21, 22, 23, and 24 adjacent to the openings therein can be used for advertising copy.

The upper end of the tubular housing 25 is closed by a top wall 34. The top wall 34 is formed with a reinforcing layer of cardboard material 34A disposed between a upper and lower sheet of plastic material 34B and 34C as will be hereinafter described.

Figure 9:
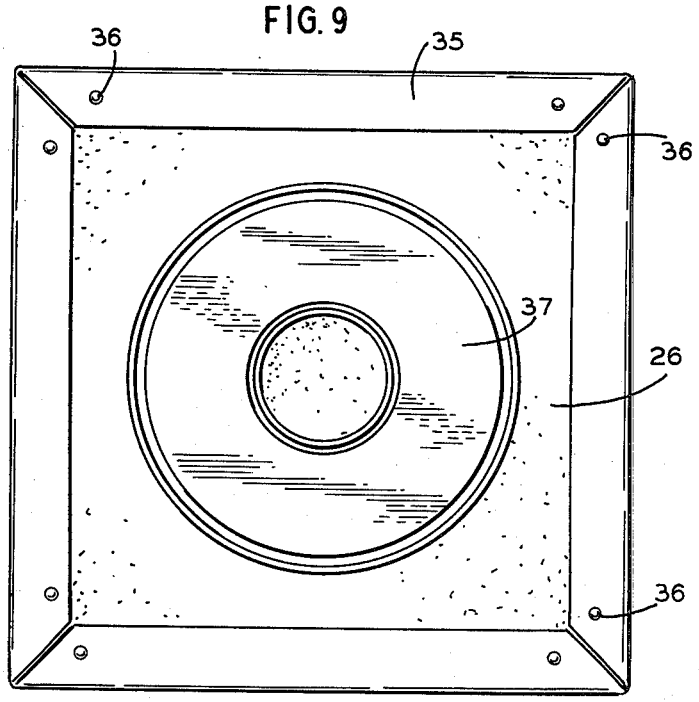
FIG. 9 is a bottom view of the display stand.

The lower most partition 26 defines the bottom wall of the housing 25. As will be hereinafter described each side wall is provided with a bottom flap 35 which is foldable inwardly as best seen in FIG. 9 to provide a support edge for the lower most tier partition or bottom 26. Rivots 36 secure the bottom tier 26 to the inturned flanges or flaps 35. Connected to the bottom 26 is a rotary base or stand 37. The base or stand 37 comprises a pair of complementary plate members one of which is fixed to the bottom wall 26 and the other rotatably mounted by means of bearings not shown. Thus the stand 37 permits one to spin or rotate the housing on the stand 37 so as to permit access to any of the openings 30, 31 and 32 in the respective side walls.

Figure 2:
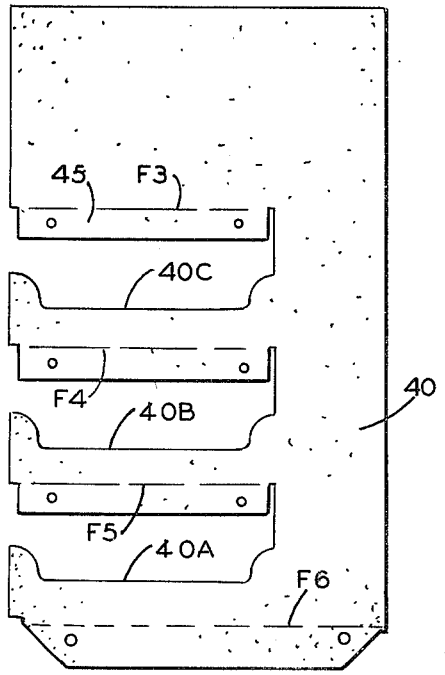
FIG. 2 is a plan view of the die-cut side wall section.

Referring in particular to FIG. 2, the blank 40 defining each of the respective side walls 21, 22, 23 and 24 comprises a sheet of reinforcing material such as cardboard, corrugated board and the like which is die cut to define a plurality of cut-out portions as indicated at 40A, 40B, and 40C. In the illustrated embodiment the cut-out portions 40A,40B and 40C are offset to one side and define the openings in the finished stand. The sheet 40 is formed with a fold line $F_3$, $F_4$ and $F_5$ which parallel the upper edge portion of the respective cut-out portions 40A, 40B and 40C to define flaps 43, 44, and 45. Parallel the bottom edge of blank 40 is a foldline $F_6$ to define the bottom flap portion 34 of the completed stand 10. The bottom corner portions of the sheet 40 are die cut at an angle so that in the folded position, as best seen in FIG. 9, the ends of the folded bottom flaps 34 are disposed in abutting position. Each of the side wall blanks 40 are similarly constructed as best seen in FIG. 2.

Figure 3:
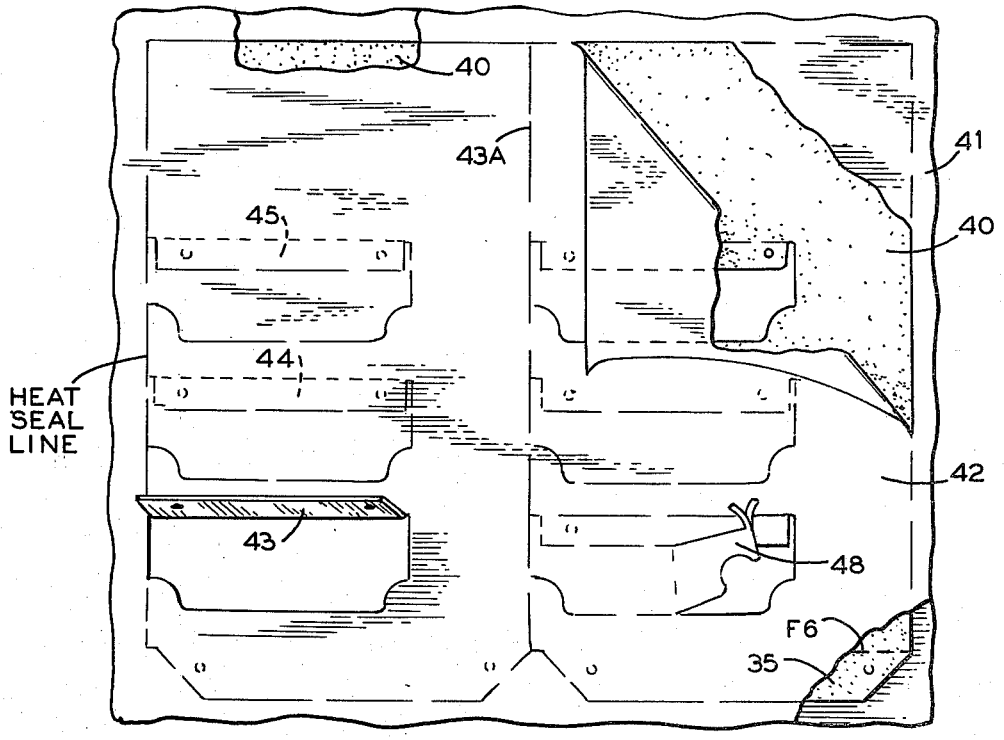
FIG. 3 is a plan view of the intermediate steps of fabricating the side wall portions of the display stand.

To form the stand 20 as shown in FIGS. 1 and 4, the respective side wall blanks 40 are die cut in the form and shape herein described and as shown in FIG. 2. Two such side wall blanks 40 are disposed in end to end position onto a sheet of plastic material such as a vinyl sheet 41. It will be understood that the vinyl sheet 41 has an area slightly greater than the combined area of two side wall blanks 40. A second sheet of plastic material 42 similar to sheet 41 is laid over the side wall blanks 40 so that the two side wall blanks are disposed between the two sheets of plastic 41 and 42. With the plastic sheets 41 and 42 disposed to either side of the side wall blanks 40—40 as best seen in FIG. 3, a heat sealing and cutting die is brought to bear on the sandwiched sheets 40 and 41 closely adjacent to the outer edge of the blanks 40, but spaced slightly therefrom. Due to the heat and pressure applied by the sealing and cutting die, the respective plastic sheets 40 and 41 are fused and cut along a seam contiguous to the contour of the blanks 40 and 41. The fused seams extends about the periphery of the blanks 40 and 41 and transversely between blanks 40 and 41 to define a seam 43A about which the two side wall formed as a unit shown in FIG. 3 can be disposed at right angles in the assembled position. The heat sealing operation described forms a fused seam about outer edges of the cardboard blank 40, and the seam so form permits the material covering the pocket openings 30, 31 and 32 to be readily separated from the plastic sheet as seen in FIG. 3 at 48.

To form the complete tubular housing structure, two double side wall panel units constructed as hereinabove stated are disposed in aligned superposed relationship and the opposed corners or edges of such superposed blanks are heat sealed or fused together along a transverse seam as indicated at 50 and 51 in FIG. 1. Two flat laminated unit sheet constructions as shown in FIG. 3, when joined together along the opposed edge portions can then be readily erected by disposing the joined wall sections at right angles.

Figure 6:
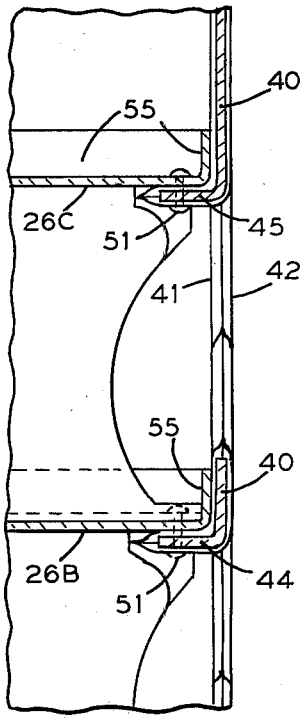
FIG. 6 is a section view taken along line 6—6 on FIG. 4.

In the erected position the respective pocket flaps 43, 44 and 45 are folded inwardly to a horizontal position to define a support for a partition tier 26A, 26B, and 26C. As best seen in FIG. 6, the partition tiers are secured to the respective inturned pocket flanges or flaps by rivots 51.

Figure 5:
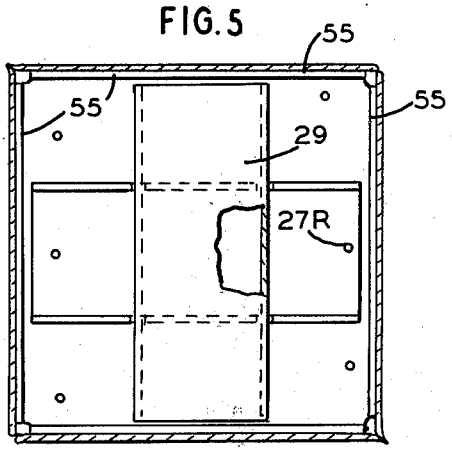
FIG. 5 is a section view taken along line 5—5 on FIG. 4.
Figure 7:
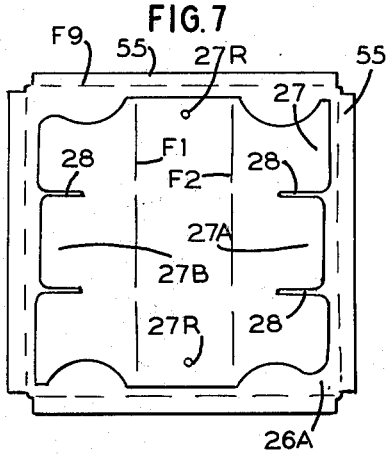
FIG. 7 is a detail plan view of a partition member.

Referring to FIGS. 5 and 7, it will be seen that each partition members, e.g. 26 is formed from a blank of cardboard type material having a circumscribing foldline $F_9$ to define marginal flaps 55. It will be understood that the intermediate partition 26A, 26B, and 26C need not be sandwiched between plastic sheets. However, the cover or top wall 34 is preferrably covered with plastic sheet material 34B and 34C. Thus to form the top wall or cover, the cardboard blank 34A is die cut to shape as best seen in FIG. 7 and the foldline $F_9$ formed therein. The die cut blank 34A is then sandwiched between two sheets of heat fuseable plastic material, and a heat sealing and cutting tool is brought to bear on the peripheral margin of the top wall 34A to fused the two plastic sheets 34B and 34C contiguous to the outer edge of the top wall blank 34A. The flaps 55 circumscribing the marginal portion of the partition are then folded out of the plane of the partition to a position at right angles thereto. The partition members are positioned into the tubular body portion of the stand so as to be supported on the inturned flaps of the respective pockets.

By the construction described the external surfaces of the stand 20 are protected by a plastic covering which is water resistant and whereby the plastic covering serves to protect the reinforcing cardboard portion of the stand. The plastic coating or covering further serves to enhance the appearance and durability of the stand and enhances a consumers attention to the products displaced thereby. The stand can be readily rotated which permits a customer to have access to all of the products contained therein. The stand thus consists of a number of like or similar component parts, thus permitting component parts of like sized stands to be interchanged with one another. The arrangement is such that the tubular body position and the respective partitions can be readily shipped in their flatten form and readily assembled at the point of use.

While the present invention has been defined and described with respect to a particular embodiment thereof, it will be readily understood and appreciated that variations and modifications can be made without departing from the spirit or scope of the invention.

What is claimed is:

1. A display stand comprising a plurality of rectangular disposed side walls integrally connected to one another to define a tubular body portion, each of said side walls including a discrete reinforcing wall forming member, each of said wall forming members having a plurality of cut out portions to define an access opening, an outer and inner covering of sheet plastic material disposed to either side of each of said respective wall forming members, a fused seam interconnecting said inner and outer plastic sheets extending transversely of said sheets between adjacent wall forming members, another fused seam interconnecting said inner and outer sheets defining each of said access openings, and a fused seam interconnecting said inner and outer plastic sheets adjacent to the upper and lower edges of said wall forming members, said side wall each having an inturned bottom flap, a bottom wall supported on and connected to said inturned bottom flaps, a plurality of partitions vertically spaced above said bottom wall, a pocket flap foldable inwardly of the tubular body about a foldline defining the upper edge of the respective access opening, said pocket flaps defining a support for intermediate partitions, a separator partition connected to each of said intermediate partitions, said separator partitions having folded end portions, and a second separator partition disposed at right angles to said first separator partition, said first and second separator partitions defining a plurality of compartments between adjacent intermediate partitions, said access opening in said side walls being open to said compartments defined between adjacent partitions, a rotary base connected to said bottom wall to permit said body portion to rotate relative to said base, and a top wall defining a closure for said body portion.

2. A display stand as defined in claim 1 wherein said top wall includes a blank of reinforcing cardboard having circumscribing inturned flaps, a liner of plastic sheet material disposed to either side of said cardboard.

3. A method for making a display stand comprising the steps of die cutting a blank sheet of material to define a plurality of cut-out portions therein, disposing two such die cut blanks in edge to edge relationships between two sheets of plastic material heat sealing said two sheets of plastic material together to form a fused seam circumscribing the outline of said respective two die cut blanks to define a section of said display stand, disposing two such heat sealed sections into overlying relationships, joining the opposed ends of said overlying sections by a fused seam, and squaring the die cut blanks sandwiched between said plastic sheets to define a tubular housing.

4. A method as defined in claim 3 and including the steps of forming said blanks with a bottom flap and a flap foldable about an edge of said cut-out portions, folding said bottom flaps inwardly of said housing, and supporting a partition on said inwardly folded flaps.

5. A method as defined in claim 4 and including the step of disposing a separator partition between adjacent partitions for defining a plurality of compartments.

6. A method as defined in claim 5 wherein said separator partitions are formed by folding two sheets of blank material about a pair of spaced foldlines and disposing said two sheets so folded at right angles to each other.

* * * * *